United States Patent [19]

Jones

[11] 4,094,723

[45] June 13, 1978

[54] VARIABLE WIDTH FILM SPLICER

[75] Inventor: Herman L. Jones, Marysville, Wash.

[73] Assignee: J & H Manufacturing, Inc., Everett, Wash.

[21] Appl. No.: 676,061

[22] Filed: Apr. 12, 1976

[51] Int. Cl.[2] ..... G03D 15/04

[52] U.S. Cl. ..... 156/353; 156/358; 156/359; 156/364; 156/506; 242/58.5

[58] Field of Search ..... 156/358, 359, 364, 505, 156/506, 518, 502, 157, 583, 380, 353; 352/80, 129; 226/199; 242/58.5

[56] References Cited

U.S. PATENT DOCUMENTS

| | | | |
|---|---|---|---|
| 2,912,516 | 11/1959 | Hallman | 352/80 |
| 3,586,571 | 6/1971 | Szakacs | 156/502 |
| 3,643,171 | 1/1972 | Rosborough et al. | 156/506 |
| 3,749,482 | 7/1973 | Greenwood | 352/80 |
| 3,769,140 | 10/1973 | Sayer | 156/157 |
| 3,884,744 | 5/1975 | Ranoche et al. | 156/380 |
| 3,896,983 | 7/1975 | Weinguni | 226/199 |
| 3,913,433 | 10/1975 | Mattews | 156/505 |

*Primary Examiner*—William A. Powell
*Assistant Examiner*—Jerome W. Massie
*Attorney, Agent, or Firm*—Dowrey & Cross

[57] ABSTRACT

The splicer includes an edge guide assembly and a splicing assembly — both being adjustable to guide and splice film of different widths. Film strips of selectable width are cut, spliced end-to-end, identified, and wound into a roll.

11 Claims, 7 Drawing Figures

VARIABLE WIDTH FILM SPLICER

BACKGROUND OF THE INVENTION

This invention relates to strip splicing and, more particularly, to splicing strips of different widths. One application of the invention illustrated and described herein is film splicing; however, the invention may be adapted to splice tapes, ribbons, bands, webs, or generally similar strip materials for photographic and/or other applications.

Present film splicers lack versatility and are uneconomical when utilized in film processing installations intended to handle film of different widths. Inasmuch as four widths (35mm, 46mm, 62mm and 70mm) are common to most types of film, present splicers typically are designed to handle only one width; therefore, commercial film processors who desire to process film types of more than one width must purchase and maintain a separate splicer for each width. Consequently, as customer demands for processing of film types of various widths rise and fall, some splicers become overloaded while others sit idle.

SUMMARY OF THE INVENTION

This invention provides a splicer for splicing strips, for example film, of different widths. The splicer includes selectively adjustable edge guide means which provide edge guidance to strips of different widths and splicing means for effecting a splice between adjacent strip ends. According to one preferred embodiment of the invention, the splicing means effect a continuous heat seal splice of selectively controllable width corresponding to strip width. (The terms "splice width" and "strip width" as used herein both refer to a direction transverse to strip length or, in most practical applications, parallel to the strip ends.)

Thus, it will be appreciated from the foregoing summary that this invention provides a highly versatile and economical strip splicer. Using this invention, therefore, commercial film processors may now maintain fewer numbers of splicers and, by selectively adjusting each splicer to handle film types of different widths, be able to respond to customer demands. Although the splice preferably is constituted by a heat seal splice effected by applying a length of heat and pressure sensitive tape between adjacent strip ends, the splice may be constituted by other means. The splice could, of course, cover less than the entire strip width and, in this case, adjustment of the splicing means might not be necessary for all width adjustments of the edge guide means. It will also be understood that this invention may be utilized to effect splices between flat, non-elongated objects (i.e., length less than width) of different widths.

These and other features, objects and advantages of the invention will become apparent in the detailed description and claims to follow taken in conjunction with the accompanying drawings in which like parts bear like reference numerals.

DETAILED DESCRIPTION OF THE DRAWINGS

Figures 1, 2:
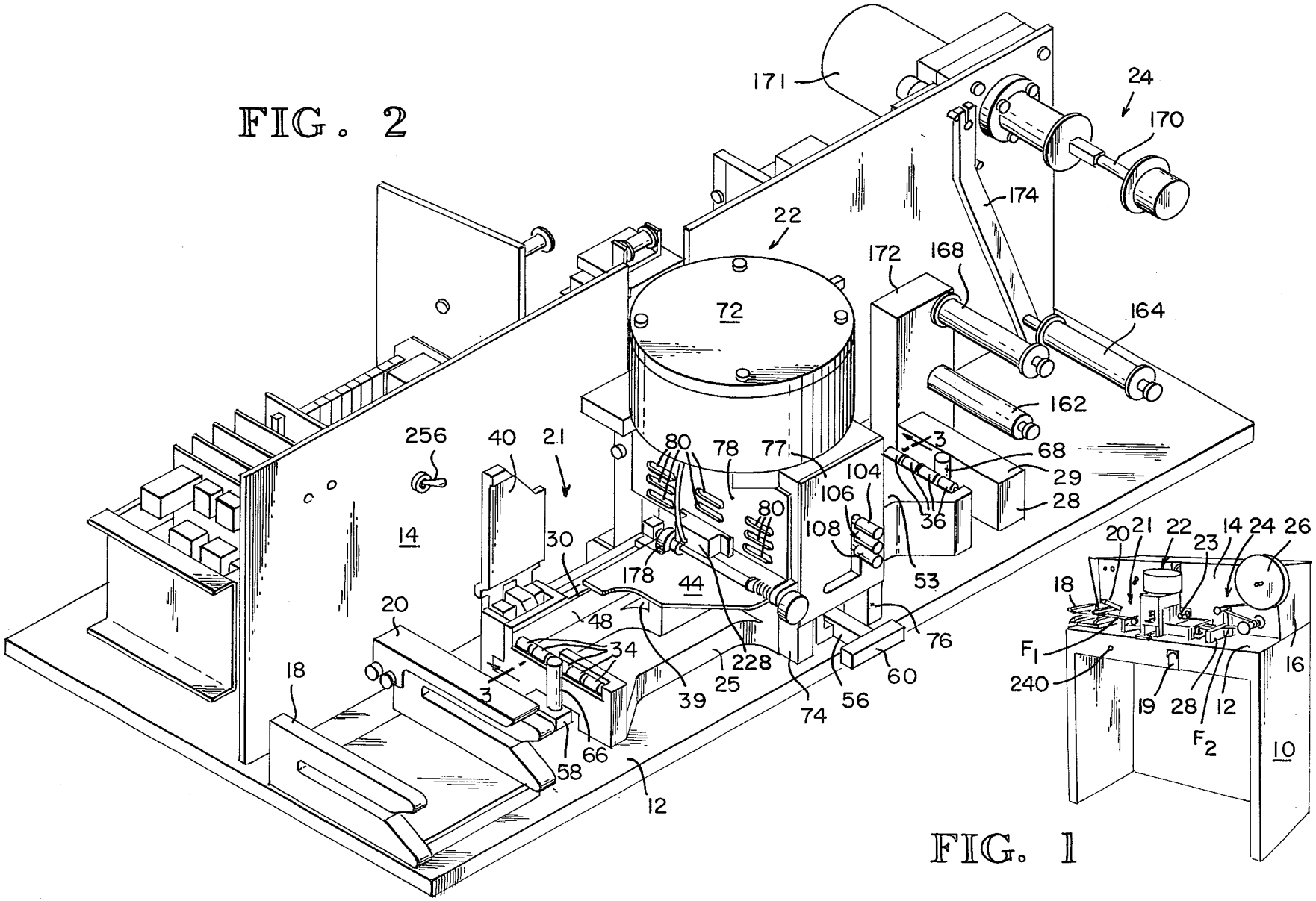
FIG. 1 is a perspective view of the variable width film splicer of this invention.
FIG. 2 is a perspective view of the FIG. 1 splicer in enlarged scale with parts broken away.

The variable width splicer is illustrated in perspective in FIG. 1. In this example, splicer assemblies and components are housed within or mounted by a stand 10 which may be mounted by appropriate wheels (not shown). The stand includes a generally horizontal rectangular deck 12, a center partition 14 upstanding from the middle of deck and extending longitudinally thereof, and a rear housing 16 secured to the upper edge of partition 14 and upstanding from the rear and side edges of deck 12, as shown (FIG. 1). FIG. 2 depicts the FIG. 1 splicer in additional detail with housing 16 removed to expose some of the remaining system components depicted schematically in FIG. 7.

The Fig. 1 splicer is suited for splicing various types of film of different widths. In this application, the splicer may be adjusted for splicing so-called "616," "116," "120," "620," "220," "127," "126," "135," "828," or other types of film which are 35mm, 46mm, 62mm, or 70mm in width. In other applications, both photographic and non-photographic, of course, the FIG. 1 splicer could be adapted to handle strips or film of different widths.

The FIG. 1 splicer includes a stripper 18 for removing film from a cartridge or unwinding a conventional roll of film, as the case may be. For cartridge film, a cartridge opener 19 may be provided. A cutter 20 is spaced from stripper 18 along the in-feed path of film strip $F_1$ and is employed to cut the leading and trailing edges of strip $F_1$. Strip $F_1$ initially is fed to the splicing station manually until its leading edge is received and positioned by a guide assembly (referenced generally by numeral 21 in FIG. 1) in adjacent end-to-end relation with preceding strip $F_2$. Assembly 21 provides edge guidance for guiding strips $F_1$ and $F_2$ along a generally rectilinear run in end-to-end relation. A splicing assembly (referenced generally by numeral 22 in FIG. 1) in overlying relation to assembly 21 intermediate the length thereof effects a heat seal splice by applying a length of pressure and heat sensitive tape between the adjacent strip ends. Both assemblies 21 and 22 are selectively adjustable in order to handle strips of different widths, as will be described presently. Upon completion of the splice, strips $F_1$ and $F_2$ are fed automatically by powered drive roller 23 toward a take-up assembly (generally referenced by numeral 24 in FIG. 1) by which they are wound onto take-up reel 26. The stripper 18, cutter 20, and assemblies 21, 22 and 24 are illustrated in enlarged scale in FIG. 2 with strips $F_1$ and $F_2$ and reel 26 removed.

To identify each fresh strip, in this case strip $F_1$, the strip feed from assembly 22 toward assembly 24 may be halted momentarily following a time interval sufficient to allow the leading edge of strip $F_1$ to reach a film identification station intermediate assemblies 22 and 24. In the FIG. 1 illustration, the film identification station is constituted by an elongated support member 28 in underlying transverse relation to the film run extending from assembly 22 to assembly 24. Member 28 provides an upper surface 29, (see FIG. 2) for supporting and maintaining the film strip generally flat during application of an identification label or the like to the upper face of the strip $F_1$. It will be recognized, of course, that film identification could be effected at the identification station by other means, for example, by photographically transferring the image of film identification indicia located on a film cartridge adjacent stripper 18 (or splicer in-feed) to strip $F_1$ when the latter is positioned at the identification station.

Figure 3:
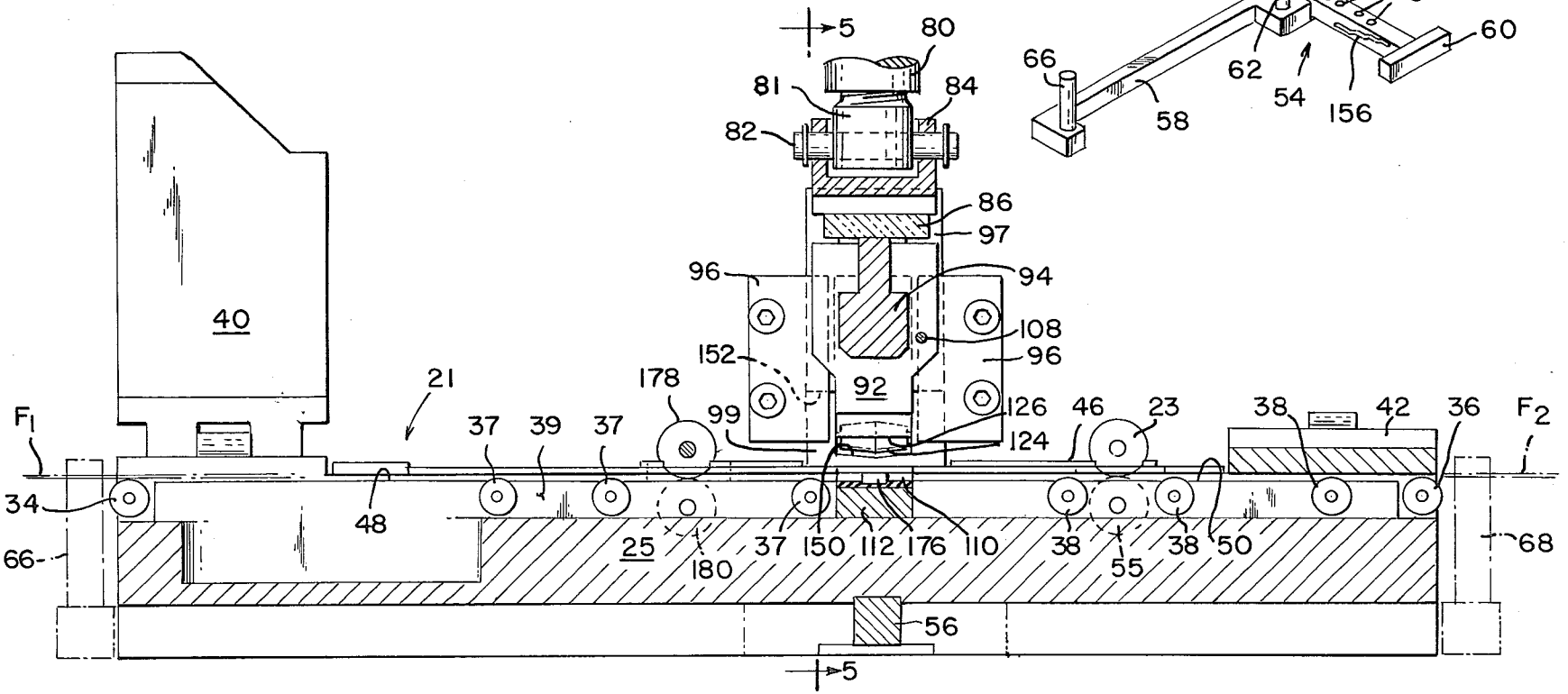
FIG. 3 is a section taken along the line 3—3 in FIG. 2.
Figure 5:
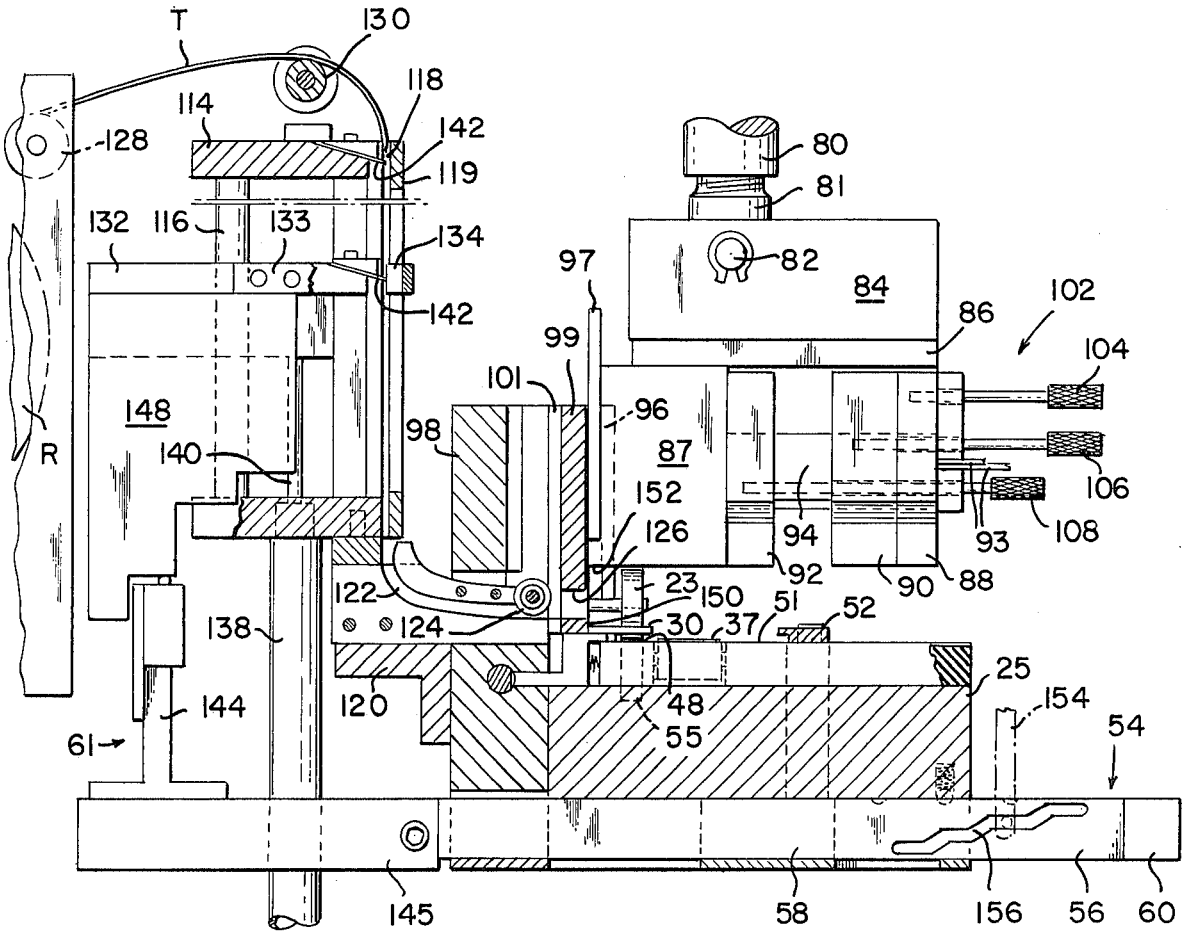
FIG. 5 is a section taken along the line 5—5 in FIG. 3.
Figure 6:
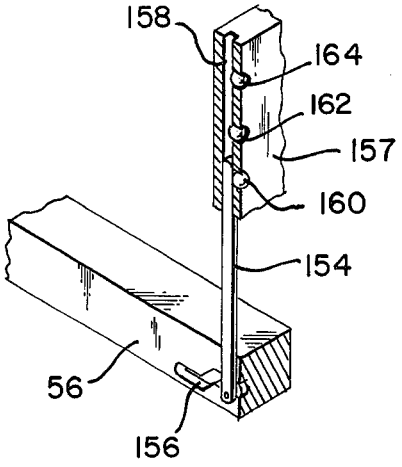
FIG. 6 is a fragmentary perspective view of the braille indicator of the FIG. 1 splicer.

Referring now to FIGS. 2, 3, and 5, the guide assembly 21 receives and guides film strips along a generally rectilinear run extending from the stripper and cutter past a splicing station located underneath assembly 22, and toward assembly 24. The guide assembly includes an elongated base 25, a fixed edge guide 30 extending the length of base 25 and adapted to engage and overlap one edge portion of strips $F_1$ and $F_2$ (see FIG. 5), a splice gap locator 176 (FIG. 3) adjacent the splicing station, lower end rollers 34 and 36 underlying the strip run and extending the width of base 25 adjacent the ends thereof, lower intermediate rollers 37 and 38 mounted within a longitudinal channel 39 underlying the strip run adjacent the base center line, pivotally mounted doors 40 and 42 (door 40 illustrated in raised position, door 42 illustrated in lowered position), and fixed intermediate covers 44 and 46 adjacent assembly 22. Base 25 includes horizontal edge support surfaces 48 and 50 in underlying relation to guide 30 and extending the length of base 25 for supporting and engaging the one strip edge portion (or the left strip edge portion as illustrated), and opposed horizontal support surfaces 51 (FIG. 5) and 53 (FIG. 2). The portion of base 25 underlying in-feed section further is recessed, as shown (FIGS. 1 and 3), in order to facilitate manual feeding of film underneath the fixed edge guide and cover 44 toward assembly 22. As most clearly shown in FIG. 3, the midportions of guide 30 and base 25 underlying assembly 22 are relieved to receive locator 176 and the splicing assembly, both to be described presently. As shown in FIGS. 3 and 5, an idler roller 55 underlies powered roller 23 to provide positive driving engagement of the left illustrated portions of the film strips therebetween. The roller 23 is driven by a suitable electric motor (not shown) operatively connected therewith by an electrically controllable clutch/brake (not shown), both of conventional design. The motor and clutch/brake are depicted schematically in and are described in additional detail hereinafter with reference to FIG. 7 of the drawings.

Figure 4:
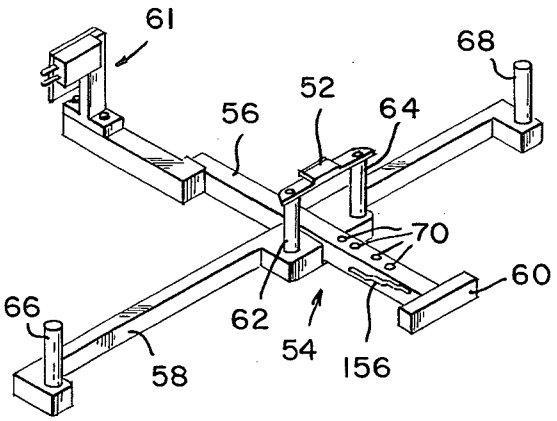
FIG. 4 is a perspective view of the edge guide and splice tape feed control of the FIG. 1 splicer.

The guide assembly further includes a movable edge guide 52 (FIGS. 4 and 5) which is adapted to engage and overlap the opposite edge of strips $F_1$ and $F_2$ and which is selectively positionable at variable spacing with respect to guide 30 by an edge guide control 54 depicted in FIG. 4. Control 54 is made up of member 56 and a perpendicular member 58. Member 56 terminates at one end in a handle 60 and is fixed at its other end to a splice tape feed control 61 to be described presently. Supports 62 and 64 are upstanding from the midportion of member 58 and respectively support the ends of guide 52. The provide additional edge guidance for portions of strips $F_1$ and $F_2$ adjacent the ends of base 25, edge guides 66 and 68 are upstanding from respective ends of member 58 in essentially coplanar alignment with guide 52. Control 54 is mounted by base 25 in underlying relation to the strip run with members 56 and 58 projecting upward toward the strip run with the upper end portions adjacent the opposite edge (or right edge as illustrated) thereof, as shown (FIG. 2). Member 56 projects from the forward face of base 25 (see FIG. 2) and is movable in and out in a direction transverse to the strip run, thereby decreasing and increasing the transverse spacing between the fixed and movable edge guides, respectively, in order to accommodate strips of varying widths. In the example, four detents 70 (FIG. 4), upstanding from member 56, independently engage a recess (not shown) in base 25 and thus allow member 56 to be positioned selectively at four predetermined positions. For film splicer application, these positions correspond to the four widths common to the several types of film mentioned hereinabove, that the splicer is intended to handle.

Referring again to FIG. 2, the splicing assembly 22 includes a double acting reciprocative air cylinder 72 which is supported from base 25 in overlying relation with the strip run by opposed generaly inverted U-shaped supports 74 and 76 which bridge the strip run in transverse relation therewith. Side covers 78 (one not shown) are secured to supports 74 and 76, and terminate at sufficient distance above the strip run to allow passage of a strip underneath. An end cover 77 extends between the forward ends of supports 74 and 76. In the illustrated heat seal splicer, covers 78 include suitable openings 80 to allow passage of cooling air therethrough.

Referring now to FIGS. 3 and 5, the aforementioned air cylinder (not shown in FIGS. 3 and 5) supports a heat and pressure application subassembly and moves it between a raised retracted position and a lowered operative position. A vertical actuator shaft 80 depends from the cylinder and is detachably connected by vertical shaft 81 and horizontal pin 82 with a support block 84. The heat and pressure application subassembly is secured to the underside of block 84 but is thermally and electrically insulated therefrom by an intervening insulator 86.

The heat and pressure application subassembly of FIGS. 3 and 5 applies heat and pressure to selected areas of the strip run and includes one stationary heat and pressure application element 87 and three independently movable heat and pressure application elements 88, 90, and 92 (see FIG. 5), all formed of thermally conductive material. Elements 87, 88, 90, and 92 include appropriate electrical heating means (not shown) which are supplied with electrical power via electrical leads 93 (FIG. 5). Movable elements 88, 90 and 92 are mounted in serial relation with respect to element 87 by a slide 94 which projects transversely from element 87 over the forward edge of base 25, as shown (FIG. 5). The heat and pressure application subassembly is guided for vertical movement with respect to base 25 by opposed stationary vertical guides 96 which overlap and engage opposed ribs 97 projecting from the rear edges of element 87. Guides 96 oppose and are mounted by a plate 99 which in turn is secured to and mounted by a rear support 98 upstanding from base 25. An insulating plate 101 may be interposed between support 98 and plate 99.

Referring now to FIG. 5 in particular, a heat and pressure application control (generally referenced by numeral 102) independently moves elements 88, 90 and 92 between respective operative positions overlying discrete areas of the strip run, thereby effectively controlling the areas to which heat and pressure application are made, depending upon strip width. Control 102 includes three elongated positioning members 104, 106 and 108 of progressively increased length and respectively secured to elements 88, 90 and 92 — member 106 extending through a passage formed in element 88, and member 108 extending through passages formed in members 88 and 90. Thus, by selectively advancing and withdrawing members 104, 106 and 108 (member 108 advanced, members 104 and 106 withdrawn in FIG. 5), elements 88, 90 and 92 can be positioned independently at their operative positions (element 92 in its operative position in FIG. 5). In the example, elements 87, 88, 90 and 92 are of appropriate heat and pressure application areas that, by appropriate combination, they provide four splice widths. Additionally, slide 94 is of sufficient length that the operative and inoperative elements may be spaced apart by a gap corresponding in width to the width of guide 52, thereby preventing collision therewith during splicing.

A lower pressure application subassembly composed of a pressure platen 110 and a support 112 (FIG. 3), both extending transversely of base 25, is located in underlying relation with elements 87, 88, 90 and 92. It is between the upper heat and pressure application subassembly and the lower pressure application subassembly that the splice tape and adjacent strip ends are compressed to effect a splice.

Referring again to FIG. 5, the splicing assembly additionally includes a splice tape feeding subassembly and a splice tape cutter for dispensing and positioning a length of splice tape corresponding to strip width in overlying engagement with adjacent strip ends in transverse alignment with the strip run. The splice tape feeding subassembly is comprised of a generally U-shaped tape feed mount 114 which supports a vertical, elongated guide rod 116 and which provides and open-ended vertical tape channel 118. A cover plate 119 secured to mount 114 encloses channel 118 and includes an elongated vertical slot through which the tape feed arm, presently to be described, projects into channel 118 to engage and advance the tape T in a downward direction. A lower tape guide 120 secured to the rear face of support 98 supports mount 114 and includes a channel 122 in communication with the lower end of channel 118. Channel 122 extends through support 98 and terminates adjacent a V-roller 124 (see also FIG. 3) which directs tape through plate 99 via rectangular aperture 126 toward the splicing station.

Splice tape T is unwound from a roll R and directed via rollers 128 and 130, the latter upstanding from mount 114 adjacent the upper end of channel 118, to channel 118, along which it is advanced by a tape feed mechanism operatively associated with mount 114. The tape feed mechanism includes a drive block 132 which is guided for vertical movement with respect to mount 114 by rod 116 and a generally L-shaped feed arm 133. Arm 133 projects from block 132 around one corner of mount 114 and terminates in a finger 134 which projects through the cover plate slot into channel 118 for frictional engagement with tape T. Block 132 and arm 133 are moved selectively with respect to mount 114 by a double acting reciprocative air cylinder (not shown) which is connected to block 132 by vertical rod 138 and reduced diameter rod 140. Thus, as block 132 and arm 133 are moved downward by this cylinder to their lowered end-of-stroke positions of FIG. 5, finger 134 engages and moves tape T correspondingly. Inclined leaf springs projecting from mount 114 engage the opposite face of tape T and prevent reverse upward movement thereof as block 132 and arm 133 are raised to their upper start-of-stroke positions.

The aforementioned splice tape feed control 61 associated with the edge guide control of FIG. 4 controls the length of splice tape advanced in this manner by selectively limiting the vertical stroke of block 132 and arm 133, depending upon the strip width setting of the edge guide control. Feed control 61 includes a positioning member 144 upstanding from a horizontal base member 146 secured to the end of edge guide control member 56 for conjoint movement therewith. A stepped cam 148 depends from block 132 in such a disposition with respect to member 144 that the upper end of member 144 is positioned in underlying relation to discrete steps at the four set positions of the edge guide control, each step providing a vertical stroke of finger 134 sufficient to advance a length of tape corresponding to strip width.

The tape cutting subassembly is located adjcacent the face of aperture 126 and includes a lower fixed shear blode 150 formed by plate 99 and an upper horizontal movable shear blade 152 formed between ribs 97 adjacent the rear end of heat and pressure application element 87. The tape cut is effected as blade 152 is moved downward past blade 150 as the heat and pressure application subassembly is lowered to its lowered splicing position.

As will now be appreciated, the edge guide control 54 also controls the tape feed while heat and pressure application are controlled independently by control 102. To correlate the strip width settings of these controls, the FIG. 7 braille indicator assembly may be provided. This assembly includes a cam follower 154, the vertical position of which is controlled by a stepped cam track 156 (see also FIG. 5) formed in member 56. Follower 154 travels up and down within a braille indicator 157 composed of a channel 158 and three balls 160, 162, 164 of sufficient diameters to partially obstruct channel 158 or protrude from the face of indicator 157, depending upon the vertical position of follower 154. Track 156 is so constructed and arranged that balls 160, 162, and 164 are positioned appropriately to indicate whether members 104, 106 and 108 should be advanced or retracted, depending upon the width setting of control 54. It will be understood, of course, that controls 54 and 102 could be operatively interconnected to provide simultaneous control of the splicing and edge guide assemblies, if desired.

The take-up assembly 24 of FIG. 2 includes a lower fixed guide roller 162, a movable guide roller 164, an upper fixed guide roller 168, and a take-up reel holder 170 powered by motor 171. Rollers 162 and 168 are supported by a support 172 upstanding from deck 12. Roller 164 is pivotally mounted by an arm 174 to swing up and down in a vertical plane.

Figure 7:
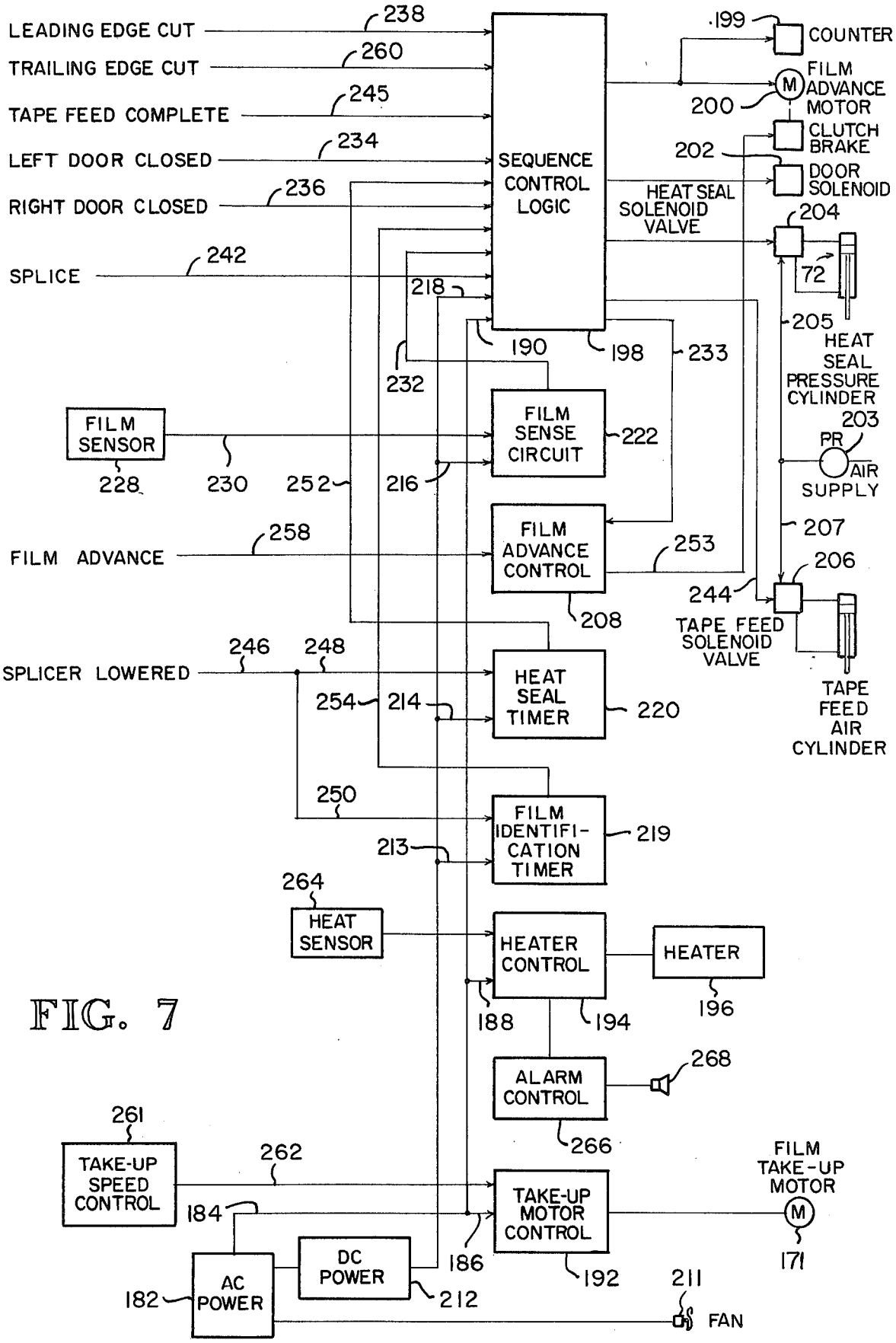
FIG. 7 is a circuit schematic of the electrical control system of the FIG. 1 splicer.

The electronic control system of FIG. 7 includes an alternating current power source 182 which delivers AC power via line 184 and respective branch lines 186, 188, and 190 to a take-up motor control circuit 192 for controlling a take-up motor; a heater control circuit 194 for controlling operation of the splicing assembly heater 196; and a sequence control logic circuit 198 for controlling a counter 199, a film advance motor 200 operatively connected with drive roller 23, a door solenoid 202 adapted to lock doors 40 and 42 in the lowered positions, air valves 204 and 206 respectively controlling operation of cylinder 72 and the tape feed cylinder, and a film advance control circuit 208. Valves 204 and 206 are supplied with air pressure from an air pressure source via pressure regulator 203, and lines 205 and 207. A cooling fan 211 also may be powered by source 182. A direct circuit power source 212 receives alternating current electrical power from source 182 and converts it into direct current electrical power which is delivered via lines 213, 214, 216 and 218 to a film identification timing circuit 219, a heat seal timing circuit 220, a film sensing circuit 222, and to circuit 198.

To initiate a splice between the leading edge of strip $F_1$ and the trailing edge of strip $F_2$ (controls 54 and 102 set to desired strip width), the leading edge of strip $F_1$ is trimmed by cutter 20, door 40 is raised to its FIG. 3 position, and strip $F_1$ is fed manually toward assembly 22 between the fixed edge guide 30 and movable edge guides 66, 52. Door 40 is operatively connected by means not shown with locator 176 (FIG. 3) which is moved, in response to such movement of door 40, toward an extended positioning interposed between the leading and trailing edges of strips $F_1$ and $F_2$. (Locator 176 is of a length which corresponds to a desired splice gap.) A manually driven roller 178 and an opposed idler roller 180 may be provided adjacent the in-feed path of strip $F_1$ to aid in positioning it with its leading edge in contact with locator 176. Door 40 and door 42, if necessary, are now closed manually.

A film sensor 228 located adjacent the in-feed path of strip $F_1$ (or between roller 178 and locator 176) senses the presence of the leading edge portion of strip $F_1$ and delivers an appropriate signal via line 230 to circuit 222 which, in turn, routes a corresponding signal via line 232 to circuit 198. Circuit 198 now energizes counter 199, motor 200 and solenoid 202 and further delivers a signal via line 233 to initiate operation of circuit 208, provided the doors 40 and 42 are closed and the leading edge cut is completed as represented by input signals on lines 234, 236 and 238 from suitable sensor means not shown. The splicer operator may now close a splice start switch 240 (see FIG. 1) which causes an appropriate splice signal to be presented to circuit 198 on line 242.

Circuit 198 now delivers an actuating signal via line 244 to valve 206 to cause the tape feed air cylinder to move the tape feed mechanism for a distance determined by the width setting of control 54 and thus dispense a corresponding length of tape. At termination of tape feed, a tape feed complete signal is delivered via line 245 to circuit 198 form tape feed sensor means not shown. In response to this signal, circuit 198 now causes valve 206 to reverse movement of the tap feed cylinder in order to return the tape feed mechanism to its raised retracted position while simultaneously therewith causing valve 204 to operate cylinder 72 in order to effect a splice.

As the heat and pressure application subassembly is lowered to effect a splice, a splicer lowered signal is delivered via line 246 and respective branch lines 248 and 250 to circuits 220 and 219. Upon expiration of a time interval sufficient to effect a splice, circuit 220 routes a splice terminate signal via line 252 to circuit 198 which then causes valve 204 to reverse movement of cylinder 72 and return the heat and pressure application subassembly to its illustrated raised retracted position.

Circuit 208 now delivers a signal via line 253 to cause the clutch of assembly 21 to be engaged with the brake released so that the now spliced strips $F_1$ and $F_2$ will be advanced along the strip run toward assembly 22. Upon expiration of another time interval sufficient for the leading edge of strip $F_1$ to reach the film identification station overlying member 28, circuit 219 delivers a film stop signal via line 254 to circuit 198 which, together with circuit 208 disengages the clutch and applies the brake of assembly 21. The operator, or appropriate film identification apparatus, now effects film identification. Upon completion of this operation, the operator actuates advance switch 256 (FIG. 2) which delivers a film advance signal via line 258 to circuit 208. This circuit causes the clutch and brake of assembly 21 to be engaged and released, respectively, so that strips $F_1$ and $F_2$ will be advanced until the trailing edge of strip $F_1$ reaches cutter 20. Using the switch 256, the operator now terminates film advance and trims the trailing edge of strip $F_1$. Upon completion of the trailing edge cut, a trailing edge cut signal is delivered via line 260 to circuit 198 which routes a signal via line 233 to circuit 208 for continuing film advance. As the trailing edge of strip $F_1$ thereafter passes sensor 228, an appropriate signal is again routed from sensor 228 via circuits 222, 198 and 208 to assembly 21 which causes the trailing edge of strip $F_1$ to be positioned adjacent the splicing station in preparation for the next splice. The door 40 also is unlocked and raised to its illustrated position by means not shown.

During the aforementioned operations, strips $F_1$ and $F_2$ are wound onto reel 170 by motor 192 under controlled tension. Tension is sensed by a take-up speed control 261 operatively associated with arm 174 and signals indicative of tension are delivered via line 262 to circuit 192 which controls operation of motor 171. Additionally, a heat sensor 264 monitors the temperature of the splicing heater 196, the temperature of which is controlled by circuit 194, and, if excessive heat develops, circuit 194 signals an alarm circuit which actuates a suitable alarm 268.

Although one preferred embodiment of the invention has been illustrated and described herein, variations will become apparent to one of ordinary skill in the art. Accordingly, the invention is not to be limited to the specific embodiment illustrated and described herein and the true scope and spirit of the invention are to be determined by reference to the appended claims.

The embodiments of the invention in while an exclusive property or privilege is claimed are defined as follows:

1. A splicer, comprising: guide means for guiding strips along a run in end-to-end relation, said guide means including spaced apart edge guide elements adjustable to accept strips of different widths along said run; splicing means mounted adjacent said run for effecting a splice between adjacent strip ends, said splicing means including applicator means adjustable to apply different lengths of splicing tape between adjacent strip ends; and control means for controlling said guide means and said splicing means by adjusting said edge guide elements to accept strips of different widths, and adjusting said applicator means to apply different lengths of splicing tape in relation to the strip widths acceptable by said edge guide elements.

2. A splicer, comprising: guide means for guiding strips along a run in end-to-end relation; splicing means mounted adjacent said run for effecting a splice of selectively adjustable width between adjacent strip ends; and control means for controlling said guide means and said splicing means; said guide means including fixed edge guide means for engaging and guiding one strip edge, and moveable edge guide means for engaging and guiding the other strip edge; said splicing means including applicator means adjustable to apply different lengths of splicing tape between adjacent strip ends; said control means being operatively associated with said moveable edge guide means and said applicator means for selectively positioning said moveable edge guide means at selected positions spaced from said fixed edge guide means in order to provide edge guidance to strips of different widths, and adjusting said applicator means to apply different lengths of splicing tape which correspond, respectively, to the spacing of said moveable edge guide means from said fixed edge guide means in order to control splice width in relation to selected strip width.

3. The splicer of claim 2, wherein said applicator means include means in overlying relation to said run for applying heat and pressure to selected areas thereof, and heat and pressure control means operatively associated with said heat and pressure application means for controlling the areas to which heat and pressure application are made.

4. The splicer of claim 3, wherein said heat and pressure application means include a plurality of heat and pressure application elements mounted for transverse movement to and from respective operative positions overlying discrete areas of said run, said heat and pressure control means being further operative for selectively positioning said elements at their operative positions in order to control the areas to which heat and pressure applications are made.

5. The splicer of claim 2, wherein said control means include means connected with said moveable edge guide means for moving said moveable edge guide means with respect to said fixed edge guide means, and means conjointly moveable with said moveable edge guide means for controlling the length of tape applied by said applicator means.

6. The splicer of claim 5, further comprising means for incrementally setting said control means such that said moveable edge guide means is positionable at multiple set positions with respect to said fixed edge guide means, and means for indicating the incremental settings of said control means.

7. The splicer of claim 2, further comprising means operatively associated with said guide means for positioning a strip at predetermined end-to-end spacing with an adjacent strip.

8. The splicer of claim 2, further comprising means operatively associated with said guide means for feeding spliced strips to an identification station, and then winding them into a roll.

9. The splicer of claim 8, further comprising means for sensing a strip and controlling said feeding and winding means.

10. The splicer of claim 2, wherein said moveable edge guide means include means for engaging the other strip edge at a plurality of spaced apart locations.

11. The splicer of claim 2, wherein said applicator means include a splice tape feed assembly which includes tape feeding means moveable reciprocatively along a path for feeding a length of splice tape into a position overlying adjacent strip ends, and wherein said control means include stop means conjointly moveable with said moveable edge guide means for establishing predetermined stop positions along the path of movement of said tape feed means at which said tape feed means may be engaged and prevented from moving farther along said path, thereby controlling the stroke of said tape feed means in order to control the length of tape applied.

* * * * *